United States Patent [19]

Kumasaka et al.

[11] Patent Number: 4,862,828

[45] Date of Patent: Sep. 5, 1989

[54] ELECTROPHOTOGRAPHIC RECORDING METHOD AND APPARATUS WITH NON-CONTACT DEVELOPMENT

[75] Inventors: Takao Kumasaka, Takahagi; Teruaki Mitsuya, Hitachi; Isamu Komatsu, Takahagi; Shigetaka Fujiwara, Yokohama; Yuzuru Shimazaki, Hitachi, all of Japan

[73] Assignees: Hitachi, Ltd.; Hitachi Koki Co., Ltd., both of Tokyo, Japan

[21] Appl. No.: 159,259

[22] Filed: Feb. 23, 1988

[30] Foreign Application Priority Data

| | | | |
|---|---|---|---|
| Feb. 27, 1987 | [JP] | Japan | 62-42643 |
| Jul. 1, 1987 | [JP] | Japan | 62-162294 |
| Jul. 29, 1987 | [JP] | Japan | 62-187597 |
| Oct. 29, 1987 | [JP] | Japan | 62-271885 |

[51] Int. Cl.[4] ..... G03G 15/09

[52] U.S. Cl. ..... 118/658; 430/122

[58] Field of Search ..... 430/122; 118/658

[56] References Cited

U.S. PATENT DOCUMENTS

| | | | |
|---|---|---|---|
| 4,672,017 | 6/1987 | Kamezaki | 430/122 |
| 4,777,107 | 10/1988 | Kurematsu et al. | 430/122 |

*Primary Examiner*—John L. Goodrow

*Attorney, Agent, or Firm*—Antonelli, Terry & Wands

[57] ABSTRACT

Non-contact type developing device and method for electrophotographic recording system. The pitch of magnetic poles on a developing sleeve carrying a developer is selected to fall within a predetermined range or is varied such that the pitch increases as the circumferential distance from the point where the gap between the developer carrier member and a photosensitive member is minimum. The bias voltage applied to the developing sleeve is controlled in accordance with a change in the size of the gap between the surface of the photosensitive member and the layer of the developer on the developer carrying member. Alternatively, the bias voltage is applied throughout a period in which the charged region on the photosensitive member is opposed by the developing sleeve.

12 Claims, 10 Drawing Sheets

ELECTROPHOTOGRAPHIC RECORDING METHOD AND APPARATUS WITH NON-CONTACT DEVELOPMENT

BACKGROUND OF THE INVENTION

The present invention relates to an electrophotographic method and also to an electrophotographic apparatus. More particularly, the invention is concerned with a method of and apparatus for conducting non-contact development of an electrostatic latent image by means of a toner.

In known non-contact type developing method as disclosed in Japanese Patent Unexamined Publication Nos. 60-242469 and 59-91453 employ a developing sleeve on which a developer layer is formed from a toner or a mixture of a toner and a carrier, and a photosensitive member which is disposed leaving a slight gap between the developer layer and the photosensitive member. In operation, a suitable level of bias voltage is developed across the gap so as to enable the toner to fly onto the photosensitive member, whereby an electrostatic latent image on the photosensitive member is developed.

The non-contact type developing method can broadly be sorted into two types: namely, (a) a mono-component layer type method in which the thin layer on the developer carrier is composed of a toner containing no carrier, and (b) a bi-component layer type method in which the thin layer is composed of a mixture of a toner and a carrier. The application of toner onto the developing roller is conducted by, for example, (a) a magnetic brush type method in which the toner is applied by a magnetic brush roll or by (b) an elastic blade which is pressed onto the developer carrier so as to apply the toner.

These known methods, however, suffer from the following disadvantages.

Namely, no specific consideration is given as to an effective pattern of distribution of the thickness of the developer layer on the developing sleeve. The size of the gap between the photosensitive member and the developing sleeve is determined by the spatial arrangement of the photosensitive member and the developing sleeve on the basis of the radii of the developing sleeve and the photosensitive member. Therefore, when the sleeve diameter is reduced, the circumferential length of the region in which the gap size is smaller than a predetermined value and which contributes to the flying of the toner is decreased with a result that the rate of flying of the toner to the photosensitive member is reduced so as to reduce the density of the print image.

The known arts also lack any consideration as to the influence of offset or eccentricity of the photosensitive member (referred to as "photosensitive drum") which is constructed in the form of a cylindrical drum. Namely, any eccentricity of the photosensitive drum causes a fluctuation in the size of the gap (referred to as developing gap) between the developing sleeve and the photosensitive drum, resulting in an unevenness of the density of the print image.

It has been a common understanding that, in non-contact development, the layer of the developer is formed as uniformly as possible and in a small thickness as possible. This is because a large thickness of the developer layer tends to cause a large fluctuation in the electric field acting on the developer layer so as to make it difficult to delicately control the electric force acting on the toner. More practically, it has been suggested that the developer layer on the sleeve optimumly has a thickness of 0.3 to 1.5 mm. To this end, it has been proposed to reduce the thickness of the developer layer by (a) reducing the gap between a thickness regulating blade and the developing sleeve or by (b) using, as the carrier, magnetic particles in the form of mixture of magnetic powders and binder resin particles so as to weaken the magnetization.

However, no proposals has been made as to the arrangement of poles of the magnet roll. For attaining a higher printing speed, it is necessary to increase the rate of fly of the toner per unit time which in turn requires that the speed of rotation of the developing sleeve to be increased. Unfortunately, however, when the gap between the thickness regulating blade and the developing sleeve is reduced, the toner tends to clog in this gap particularly when the rotation speed of the developing sleeve is increased. In consequence, lines such as those formed by brooming are formed in the toner layer on the developing sleeve. Conversely, in the system in which a carrier containing a binder is used, there is a risk for the developer to be scattered due to centrifugal force when the rotation speed is increased, because of a too small magnetic attracting force.

In the mono-component layer type method, the use of a magnetic brush as the means for applying a toner increases the size of the developing apparatus. On the other hand, the elastic-blade type developer applicator for applying toner to the developing roll tends to cause the toner and other component to stick to the developing roll, resulting in a lack of stability.

The bi-component layer type method is advantageous because it can contribute to a simplification in the construction without being accompanied by any increase in the size. This method, however, involves a risk that the carrier may fly together with the toner towards the photosensitive drum during developing or when the development is not conducted. To obviate this problem, Japanese Patent Unexamined Publication No. 60-242469 proposes a method in which an electrically insulating carrier is used to prevent the carrier from flying. The use of electrically insulating carrier, however, is disadvantageous in that the carrier may undesirably fly towards the photosensitive member by application of an electric field of a reverse polarity.

SUMMARY OF THE INVENTION

Accordingly, an object of the present invention is to provide a non-contact type developing device for use in electrophotographic recording of information, capable of overcoming the above-described problems of the prior art.

Another object of the present invention is to provide a non-contact type developing device suitable for use in electrophotographic recording apparatus, capable of eliminating generation of unevenness in the density of the recorded image even when there is any eccentricity of a photosensitive drum, thereby overcoming the above-described problem of the prior art.

Still another object of the present invention is to provide a small-sized non-contact type developing device which is capable of performing high-speed development of latent image, thereby overcoming the above-described problem of the prior art.

A further object of the present invention is to provide recording method and apparatus which is suitable for use in color printing of information on a cut paper by non-contact type developing method and which is capable of preventing a carrier from flying when development is not conducted, without being accompanied by increase in the consumption of toner, as well as difficulty in cleaning of photosensitive drum.

According to one aspect of the present invention, a magnetic toner or a mixture of a non-magnetic toner and a magnetic carrier is used as the developer, and the thickness of the developer layer on the developing sleeve facing the photosensitive drum is so varied that the thickness progressively increase as the distance from the point of the minimum gap increases.

According to another aspect of the invention, any change in the distance between the surface of the photosensitive drum and the developing sleeve is detected by a displacement sensor and the bias voltage is controlled in accordance with the output of the displacement sensor which represents a change in the distance between the surface of the photosensitive drum and the developing sleeve.

According to still another aspect of the invention, the number of poles of a magnet roll is determined to fall within a predetermined range.

According to a further aspect of the invention, the bias voltage for causing a toner to fly during non-contact development is controlled such that it is not immediately reduced to zero when the non-contact development is ceased but is maintained throughout a period which includes a period in which the developer carrier faces a portion of the photosensitive member charged to a high potential level.

These and other objects, features and advantages of the present invention will become clear from the following description of the preferred embodiments when the same is read in conjunction with the accompanying drawings.

DESCRIPTION OF THE PREFERRED EMBODIMENTS

Figure 1:
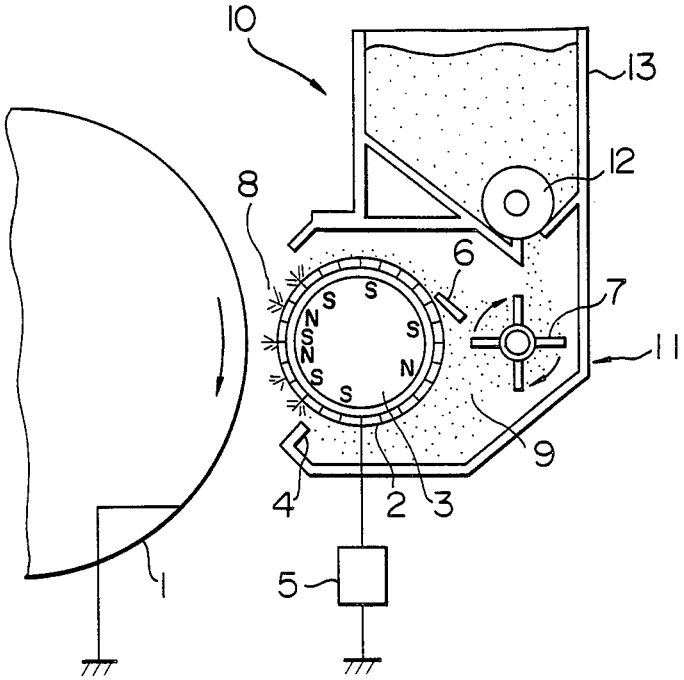
FIG. 1 is a vertical sectional view of a first embodiment of the present invention.

A developing device constructed in accordance with a first embodiment of the invention will be described hereinunder with specific reference to FIGS. 1 and 2. The developing device, generally designated at 10, includes a photosensitive member 1 which carries an electrostatic latent image formed thereon, a non-magnetic developing sleeve 2, a magnet roll 3, a thickness regulating plate 4, a power supply 5 for supplying bias voltage to the developing sleeve 2, a scraper blade 6, a stirring member 7, a toner supply roller 12 and a toner hopper 13 containing a developer 9. A reference numeral 8 denotes bits of a magnetic brush of developer formed on the developing sleeve 2. The constituents 2 to 13 in combination constitutes a developing unit which is generally designated at 11. As will be clearly seen from FIG. 2, the pitch of the magnetic poles of the magnet in the magnet roll 3 is varied in the portion adjacent to the photosensitive member 1 such that the pitch is smallest in the region closest to the photosensitive member 1 but progressively increases as the distance from the closest region increases.

The developer 9 may be a magnetic toner or a mixture of a non-magnetic toner and a magnetic carrier. The developer 9 is attracted by the magnetic attracting force produced by the magnet roll 3 placed in the sleeve 2 so as to form continuous chains of developer which extend in the direction of the line of magnetic force. These chains as a whole is usually called "magnetic brush" so that the term magnetic brush will be used hereinunder to represent the continuous chains of the developer. The magnetic brush has bits 8 which are the chains of large lengths formed immediately above the magnetic poles. The inventors have conducted a test to examine the relationship between the height of the bit of magnetic brush and the pitch of the magnetic poles, and found that the greater the pitch of the magnetic poles, the larger the height of the magnetic brush bit, as shown in FIG. 2. Therefore, if the pitch of the magnetic poles is so varied as to increase in accordance with the increase in the circumferential distance from the portion where the gap between the photosensitive member 1 and the sleeve 2 is minimum, the height of the bits of the magnetic brush is increased correspondingly. The flying of the developer from the developing sleeve to the photosensitive member takes place only in the region where the distance between the developer layer and the photosensitive member is smaller than a predetermined value. In the described embodiment, the height of the bits of the magnetic brush, i.e., the thickness of the developer layer, increases as the circumferential distance from the point of the minimum gap size increases, so that the size of the circumferential region which contributes to the flying of the developer is materially increased as compared with the case where the developer layer has a constant thickness over the entire circumference, thus contributing to an increase in the recording density.

Figure 2:
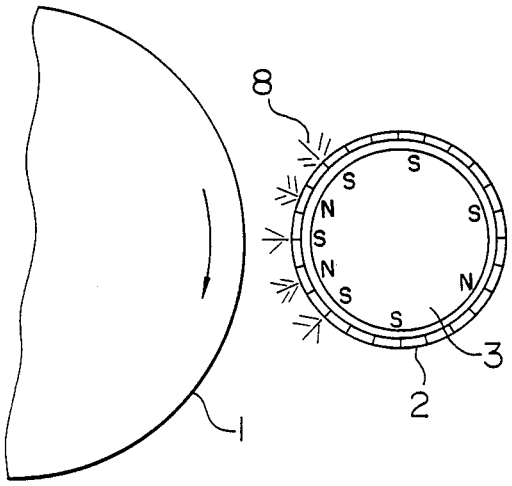
FIG. 2 is an enlarged view of a portion of the embodiment shown in FIG. 1.

In the arrangement shown in FIGS. 1 and 2, the developer is attracted by the magnetic force of the magnet roll 3 so as to be held on the surface of the sleeve 2 and is brought to the region were the developer faces the photosensitive member 1, as a result of rotation of the sleeve. In consequence, the particles of the developer form a brush with bits 8 extending along the lines of magnetic force formed by the magnetic poles. As will be seen from FIG. 3, the height of the bits 8 has a certain relation to the distance between adjacent magnetic poles, i.e., the pitch of the magnetic poles. More specifically, the greater the pitch of the magnetic poles, the larger the height of the bits 8. According to the invention, therefore, the height of the bits 8 is progressively increased as the circumferential distance from the point of the smallest gap increases.

Figure 4:
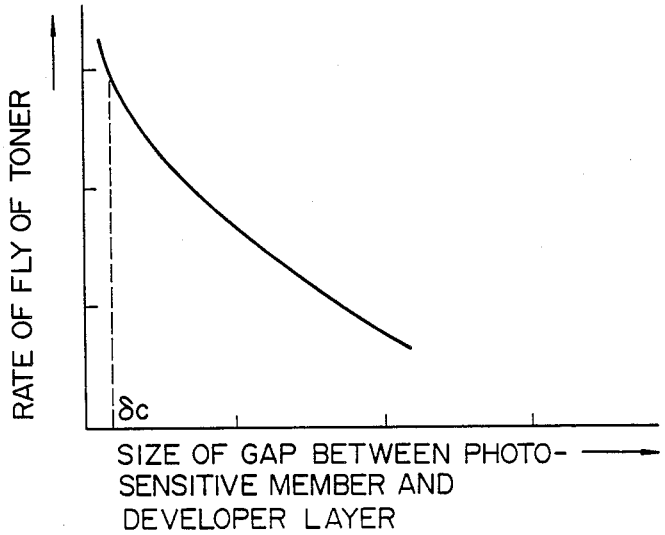
FIG. 4 is a graph showing the relationship between the rate of fly of a toner and the size of a gap between a photosensitive member and a developer layer.

In the non-contact type development of latent image, the development is effected by causing only the toner to fly from the developer layer by application of a bias voltage between the sleeve 2 and the photosensitive member 1. FIG. 4 shows the relationship between the size of the gap between the photosensitive member 1 and the developer layer and the rate of fly of the toner. It will be seen from this Figure that the rate of fly of the toner drastically decreases as the gap size increases. In other words, only the portion of the developer layer 9 which resides in the region where the gap size is below a predetermined value can take part in the flying of the toner. According to the invention, the circumferential region in which the developing gap is below a predetermined value is increased as compared with the case where the height of the bits 8, i.e., the developer layer thickness, is uniform over the entire circumference of the sleeve 2. This means that a greater region can contribute to the flying of the toner so that the printing density is increased.

Figure 5:
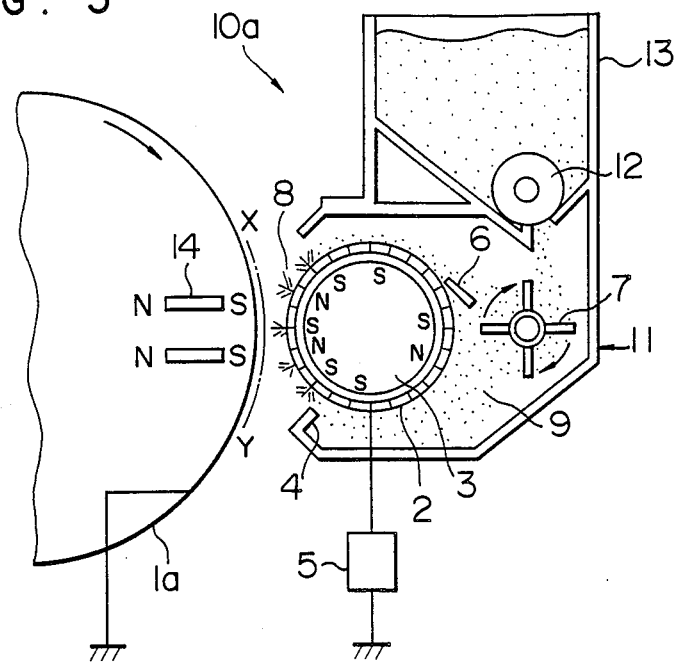
FIG. 5 is a vertical sectional view of a second embodiment of the present invention.

FIG. 5 shows a developing device 10*a* in accordance with the second embodiment of the present invention. The second embodiment is different from the first embodiment shown in FIGS. 1 and 2 in that a magnet 14 is disposed in the photosensitive member 1*a*. As will be seen from FIG. 5, the magnet 14 is located at a position which is slightly spaced apart from the position where the size of the gap between the photosensitive member 1*a* and the sleeve 2 is minimum. In this case, the pitch of the magnetic poles on the sleeve 2 may be non-uniform as in the case of FIG. 2 or may be uniform.

The arrangement shown in FIG. 5 produces an effect that the height of the bits 8 of the magnetic brush is increased in the region slightly spaced apart from the point of the minimum gap, thanks to the effect of the magnet 14 disposed in the photosensitive member 1*a*. Preferably, the ends of the bits 8 of the magnetic brush are located on an imaginary circle (X-Y in FIG. 5) which is concentric with the photosensitive member 1*a*. In consequence, the circumferential length of the region contributing to the flying of the toner is increased to ensure a higher density of the recorded image. The second embodiment therefore offers advantages in that the magnetic roll can have a constant pitch of the magnetic poles and that the height of the magnetic brush bits can be controlled by varying the strength of magnetic force of the magnet 14, although the construction as a whole is complicated as compared with the first embodiment.

Thus, in the first and second embodiments described hereinunder, it is possible to obtain a higher density of the recorded image because the circumferential length of the region of the developer layer which contribute to the flying of the toner is increased as compared with the case where the developer layer has a constant thickness over the entire circumference of the sleeve 2. In other words, the printing speed can be increased provided that the diameter of the developing sleeve is unchanged.

Figure 6:
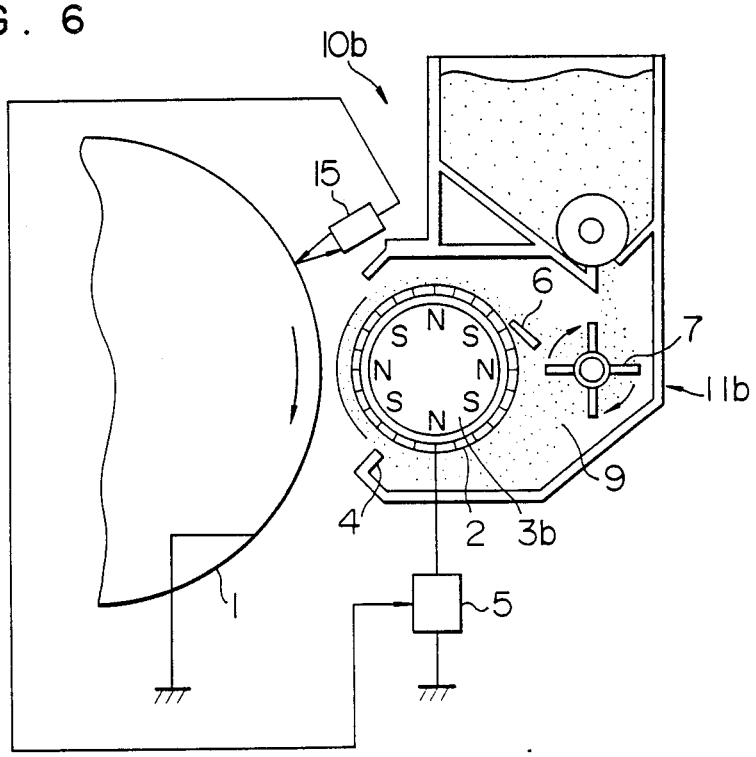
FIG. 6 is a sectional view of a third embodiment of the present invention.

A third embodiment 10*b* of the developing device in accordance with the present invention is shown in FIG. 6 in which the same reference numerals are used to denote the same parts or members as those appearing in FIG. 1 showing the first embodiment 10.

As will be seen from this Figure, the developing device 10*b* of the third embodiment has a photosensitive drum 1, a developing unit 11*b*, a bias power supply 4 and a displacement sensor 15. As in the case of the first embodiment shown in FIG. 1, the developing unit 11*b* is constituted by a developing sleeve 2, a thickness regulating blade 4, a scraper blade 6, a stirring member 7 and a magnet roll 3*b*. Unlike the first embodiment, the magnetic poles of the magnet roll 3 in this embodiment are arranged at a constant pitch.

The photosensitive drum 1 is capable of forming an electrostatic (charge) latent image formed on the surface thereof. As shown by an arrow in FIG. 6, the displacement sensor 15 is adapted to detect the displacement (distance) of a measured object, by applying a light beam to the object and then measuring the intensity of the light reflected by the object. More specifically, the displacement sensor 15 is disposed in the vicinity of the developing unit 11*b* so as to determine the distance between the sensor 15 and the surface of the photosensitive member 1 near the developing sleeve 2. The bias power supply 5 has a control circuit which outputs a voltage which varies in accordance with the signal from the displacement sensor 15. The output voltage is applied to the sleeve 2 as a signal for controlling the bias voltage.

In operation, the developer 9 stirred by the stirring member 7 is applied to the developing sleeve 2 and the toner is transferred under application of the bias voltage to the electrostatic latent image on the photosensitive drum 1 thereby developing the image to form a toner image on the photosensitive drum 1. The displacement sensor 15 detects any displacement of the surface of the rotating photosensitive drum 1 attributable to eccentricity of the photosensitive drum 1, in the region near the developing unit 11*b*, and delivers a signal to the bias power supply 5. Upon receipt of this signal, the bias power supply 5 controls the level of the output voltage, whereby a constant level of image density is obtained despite any oscillation of the surface of the photosensitive drum 1 attributable to eccentricity. More specifically, the bias power supply 5 controls the bias voltage such that the level of the bias voltage is increased when the developing gap is increased as a result of oscillation of the photosensitive drum surface. Conversely, when the developing gap is reduced, the bias voltage is decreased correspondingly.

Figure 3:
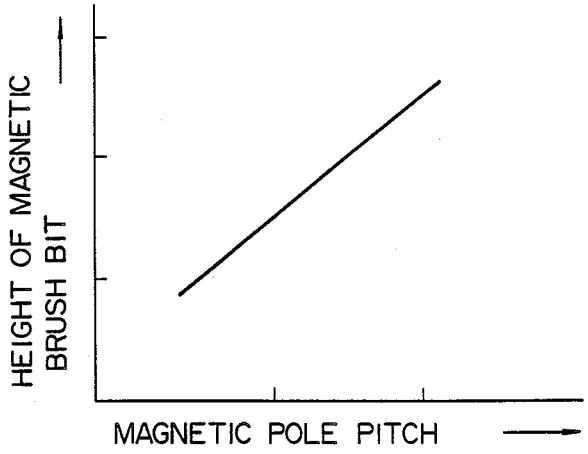
FIG. 3 is a graph showing the relationship between the pitch of the magnetic pole and the height of the magnetic brush.

Thus, the developing device in accordance with the third embodiment as shown in FIG. 3 makes it possible to obtain a toner image density which falls within a predetermined range, thereby suppressing any tendency for the recorded image density to become uneven.

As explained before, the non-contact type developing method relies upon the flying of a toner from a toner or developer layer on a developing sleeve towards a photosensitive drum under the influence of a bias voltage. The present inventors have conducted an experiment to investigate the relationship between the density of the toner image on the photosensitive drum (referred to as developing density) and the developing gap size, as well as the relationship between the developing density and the level of the bias voltage.

Figure 7:
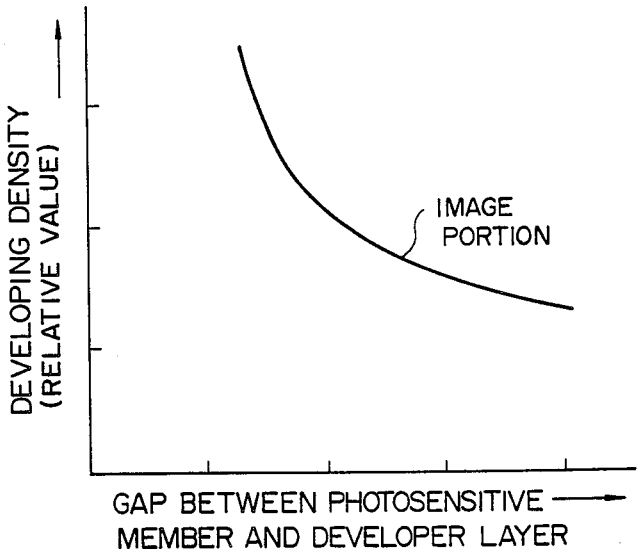
FIG. 7 is a graph showing the relationship between the developing gap and the density of recorded image.
Figure 8:
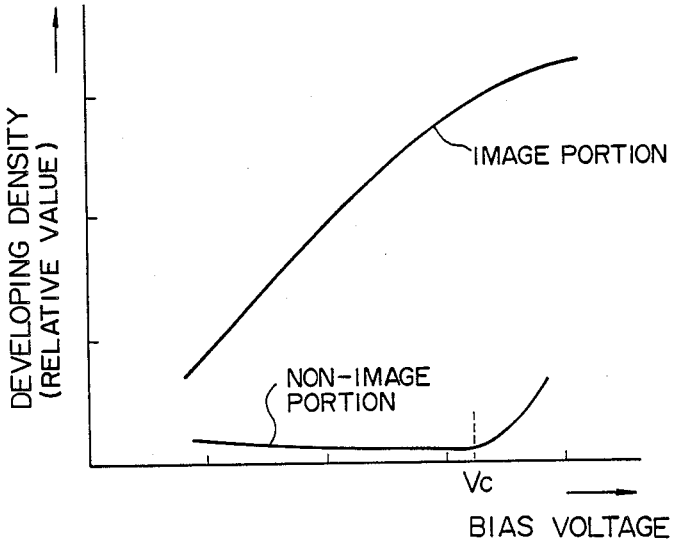
FIG. 8 is a graph showing the relationship between the bias voltage and the density of recorded image.

FIGS. 7 and 8 are graphs which show, respectively, the relationship between the developing density and the developing gap size and the relationship between the developing density and the bias voltage level, obtained through the experiment. In FIG. 8, the curve "image portion" represents the black portion of the image, while the curve "non-image portion" corresponds to white portion of the image.

From FIG. 7, it will be understood that the developing density becomes lower as the developing gap size increases, provided that the bias voltage is maintained constant. This means that the density of the printed image become lower when the developing gap size is increased due to the eccentricity of the photosensitive drum. Conversely, when the developing gap size decreases as a result of oscillatory motion of the photosensitive drum due to eccentricity, the density of the recorded image is increased. Referring now to FIG. 8, provided that the developing gap size is constant, the developing density increases and decreases, respectively, as the bias voltage level gets higher and lower. However, when the bias voltage exceeds a predetermined level, the density of the white portion of the image increases due to a phenomenon known as "fogging".

According to the invention, it is possible to eliminate unevenness of the recorded image density attributable to eccentricity of the photosensitive drum, by detecting the change in the developing gap by means of the displacement sensor and varying the bias voltage in such a manner as to compensate for the change in the developing gap size. Namely, the bias voltage level is increased and decreased, respectively, when the developing gap size is increased and decreased from a predetermined value, thus maintaining the developing density within a predetermined range, thereby to prevent any appreciable unevenness in the density of the recorded image.

Figure 9:
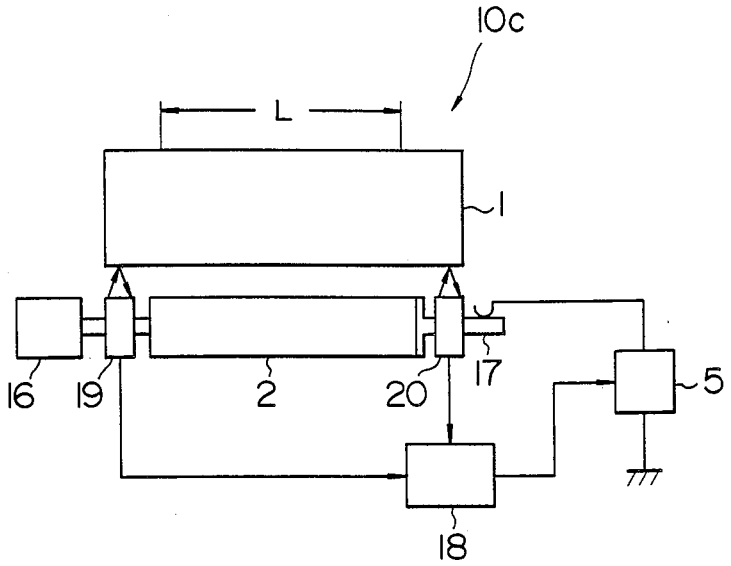
FIG. 9 is a plan view of a fourth embodiment of the present invention.

FIG. 9 is a plan view of a developing device 10c in accordance with a fourth embodiment of the present invention. Referring to FIG. 9, the developing device has a drive motor 16, a power supply member 17, an arithmetic unit 18 and displacement sensors 19, 20. Other portions are materially the same as those in the third embodiment shown in FIG. 6 and are denoted by the same reference numerals as those used in FIG. 6.

More specifically, the fourth embodiment of the developing device 10c is different from the third embodiment shown in FIG. 6 in that a pair of displacement sensors 19, 20 are disposed in the region where the developing sleeve 2 and the photosensitive drum 1 face each other, and the arithmetic unit 18 receives signals from these sensors 19, 20 so as to produce a control signal to be delivered to the bias power supply 5. The displacement sensors 19, 20 are disposed outside the printing region L on the photosensitive drum 1 so that the light beams from these sensors 19, 20 may not damage the electrostatic latent image on the surface of the photosensitive drum 1.

In the fourth embodiment shown in FIG. 9, the arithmetic unit 18 computes the mean value of the outputs from the displacement sensors 19, 20 so that the bias power supply 5 can control the bias voltage on the basis of the mean value of the change in the developing gap along the axis of the photosensitive drum. It is therefore possible to substantially uniformalize the developing density, even when there is a slight variation in the developing gap along the axis of the photosensitive drum 1. In addition, this fourth embodiment offers the same advantages as those brought about by the third embodiment explained before in connection with FIG. 6. The fourth embodiment also includes a drive motor 16 for driving the developing sleeve 2 and the power supply section 17 for applying a bias voltage to the developing sleeve 2. The drive motor 16 and the power supply section 17 are provided also in the preceding embodiments.

Figure 10:
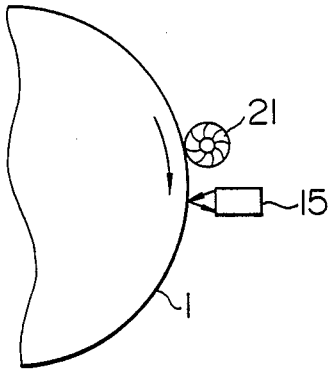
FIG. 10 is a sectional view of a part of the fifth embodiment of the present invention.

FIG. 10 illustrates in section an essential portion of a fifth embodiment of the present invention. The fifth embodiment features a cleaning means which is denoted by 21. Other portions are materially the same as those of the third embodiment shown in FIG. 6 and the fourth embodiment shown in FIG. 9.

The cleaning means 21 is disposed upstream of the displacement sensor 15 or sensors 19, 20 as viewed in the direction of rotation of the photosensitive drum 1. Thus, any contaminant such as the toner particles, paper dusts and so forth on the displacement measuring portion or portions of the photosensitive drum 1 are always wiped off to allow these portions to be kept clean, thus ensuring a high accuracy of detection of the displacement thereby preventing any detection error from occurring.

The cleaning means 21 may be constituted by a suitable cleaning device such as a fur brush, blade or a suction cleaning device.

In the third, fourth and fifth embodiments described hereinbefore, the change in the size of the developing gap between the photosensitive drum 1 and the developing sleeve 2 relies solely upon the detection of eccentricity of the photosensitive drum 1. Actually, however, the developing sleeve 2 also may have an inevitable eccentricity. The eccentricity of the developing sleeve 2, however, does not matter because the diameter of the developing sleeve 2 is so small that the influence on the developing gap size is not significant as the case of the eccentricity of the photosensitive drum 1. Thus, the arrangements of the third to fifth embodiments can provide materially constant density of the recorded image. However, if a higher accuracy of the control of the recorded image density is required, the invention does not exclude the use of a displacement sensor capable of detecting any eccentricity of the developing sleeve. In such a case, the arithmetic unit 18 computes the signals from the sensor or sensors for detecting the eccentricity of the photosensitive drum and the output from the displacement sensor sensitive to the eccentricity of the developing sleeve, so that the bias voltage is controlled taking into account the eccentricity of the photosensitive drum 1, as well as the eccentricity of the developing sleeve 2. In this case, the displacement sensor for detecting the eccentricity of the developing sleeve has to be positioned such that it detects the axial end portion of the developing sleeve where the developer is not present.

Although the displacement sensors in the third to fifth embodiments described hereinbefore are optical sensors which make use of light beams, this type of sensor is not exclusive and the sensor may be a magnetic sensor which makes use of a high-frequency magnetic field or a supersonic sensor which makes use of supersonic wave, as well as an infrared sensor. The use of a magnetic sensor is advantageous in that it is capable of detecting the displacement exactly regardless of presence of any contaminant on the photosensitive drum, because it is sensitive only to the metallic surface of the photosensitive drum.

As has been described, in the third to fourth embodiments of the present invention, the bias voltage is controlled in such a manner as to compensate for any change in the size of the developing gap attributable to, for example, an eccentricity of the photosensitive drum, so that the tendency for the density of the recorded image to fluctuate is remarkably suppressed, thereby ensuring a high quality of the recorded image falling within an acceptable range.

Figure 11:
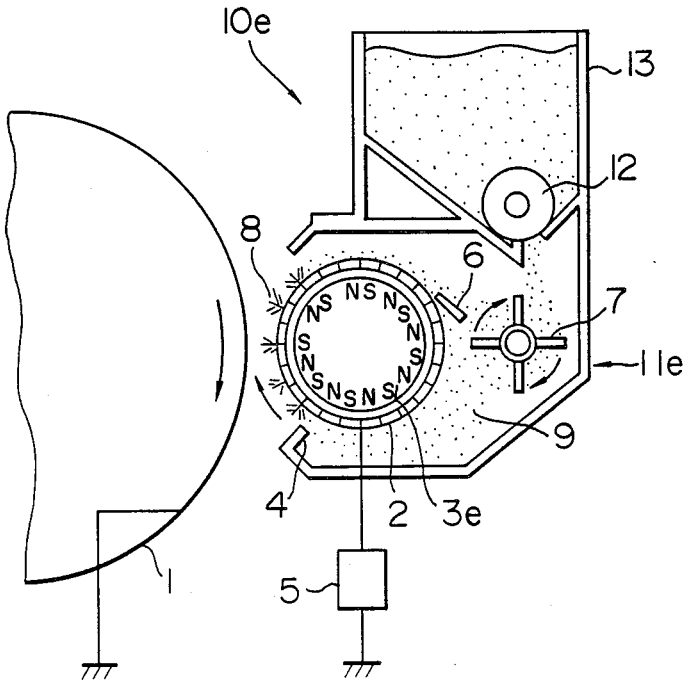
FIG. 11 is a vertical sectional view of a sixth embodiment of the present invention.

FIG. 11 shows a developing device 10*e* in accordance with a sixth embodiment of the present invention. This developing device 10*e* is materially identical to the developing device 10 of the first embodiment shown in FIG. 1 except for the arrangement of the magnetic poles on the magnet roll 3*e*. Thus, in FIG. 11, the same reference numerals are used to denote the same parts or members as those used in FIG. 1.

As explained before, the height of the bits of the magnetic brush can be reduced by reducing the pitch of the magnetic poles, i.e., by increasing the number of the magnetic poles, on the magnet roll. If the height of the bits is reduced, it is not necessary to reduce the gap provided by the thickness regulating blade for thinning the developer layer on the developing sleeve. This in turn eliminates restriction on the type of the carrier and makes it possible to use a magnetic carrier in the developer. In consequence, a stronger magnetic force is applied to the developer so as to prevent the developer from being scattered. However, a too small pitch of the magnetic poles on the magnet roll will cause the frequency of the alternating magnetic field produced by rotating magnet roll so that the developer fail to move in response to the movement of the magnetic field. Thus, a "slip" of the developer will occur on the developing sleeve, resulting in a lower efficiency of convey of the developer.

For the purpose of attaining a higher rate of fly of the toner, it is necessary that a large number of bits of the magnetic brushes which approach the photosensitive member is generated in the developing region. This is because the highest intensity of the electric field appears in the region near the ends of the bits so that the toner particles on the ends of the bits are most liable to fly. The number or frequency of generation of the magnetic brush bits can be increased by reducing the pitch of the magnetic poles, i.e., by providing a greater number of magnetic poles.

In order to form a thin layer of the developer while increasing the rate of fly of the toner, it is effective to determine the number of the magnetic poles on the magnet roll to fall within a suitable predetermined range. Thus, the tendency for the developer to clog or scatter can be reduced even when the development is conducted at a high speed, by suitably selecting the number of the magnetic poles on the magnet roll.

A description will be made hereinunder as to the practical range of the pitch of the magnetic poles, as well as the results of experiment which was conducted for the purpose of determining such a practical range.

In general, the amount m of deposition of the toner per unit area is proportional to the density D of the toner image. On the other hand, the relationship between the printing speed (peripheral speed of the photosensitive drum) $V_p$ and the density D of the toner image is roughly given by the following formula (1).

$$D \propto \frac{1}{V_p l} \cdot M \qquad (1)$$

where, M represents the rate of fly of toner per unit time, while l represents the printing width, i.e., the length of the image in the direction of axis of the photosensitive drum.

From the formula (1) above, it will be understood that, in order to attain a predetermined image density while increasing the printing speed $V_p$, it is necessary that the rate M of fly of the toner per unit time be increased.

Figure 12:
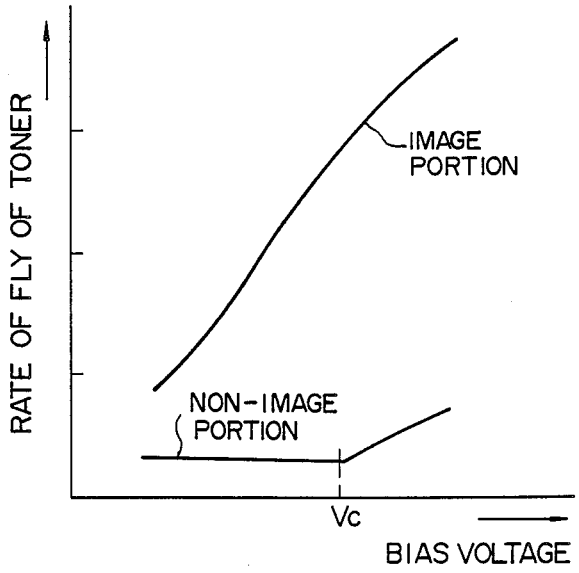
FIG. 12 is a graph showing the relationship between the rate of fly of a toner and bias voltage.
Figure 13:
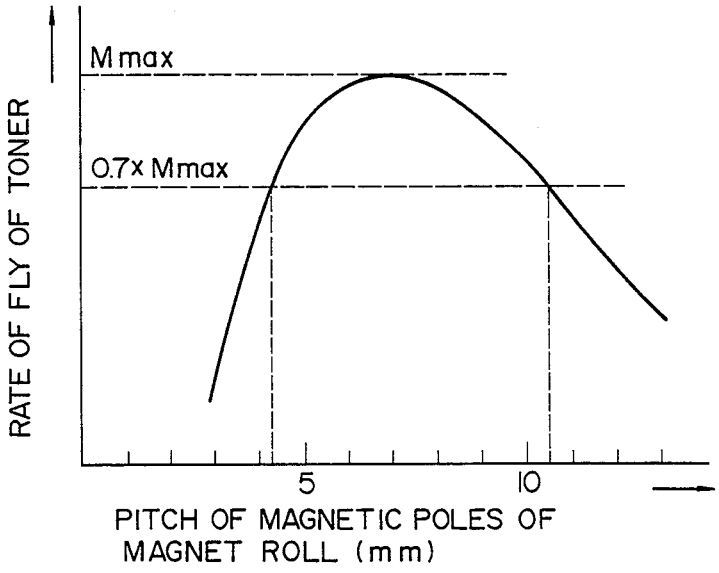
FIG. 13 is a graph showing the relationship between the rate of fly of a toner and the pitch of magnetic poles.

The inventors therefore conducted experiments to examine how the rate M of fly of the toner is affected by the factors of development such as the bias voltage, developing gap and the pitch of the magnetic poles, and the following characteristics or tendencies as shown in FIGS. 4, 12 and 13 were obtained. In these Figures, the curves "image portion" represents black portion of the image while the curves "non-image portion" represents the white portion of the image.

(1) As shown in FIG. 12, the rate M of fly of the toner increases as the bias voltage increases, provided that the developing gap and the magnetic pole pitch are unchanged. However, when the bias voltage exceeds a threshold voltage $V_c$, the rate of fly of the toner onto the non-image portion increases undesirably so as to cause a phenomenon known as "fogging". The bias voltage therefore should be set at a level which is equal to the threshold value $V_c$ or slightly below the same. The threshold value $V_c$ was found to be substantially equal to the potential $V_o$ of the surface of the photosensitive member.

(2) As will be seen from FIG. 4, when the bias voltage and the magnetic pole pitch are constant, the rate of fly of the toner drastically decreases when the developing gap, i.e., the gap between the developing layer and the photosensitive member, is increased. The developing gap, therefore, should be reduced as much as possible while maintaining the "non-contact" state of development. Actually, however, there are inevitable mechanical or dimensional errors due to, for example, eccentricity of the photosensitive member. Practically, therefore, a gap on the order of 100 to 300 μm is formed between the photosensitive member and the ends of the magnetic brush bits so as to maintain the "non-contact" state of development. This minimum gap will be referred to as "minimum gap" and represented by $\delta_c$, hereinunder.

(3) As will be seen from FIG. 13, the rate of fly of the toner is maximized when the pitch of the magnetic poles on the magnet roll is about 6.5 mm, under the application of the threshold bias voltage and the presence of the minimum gap. This is attributable to the fact that a too small pith of the magnetic poles causes the developer to slip to reduce the efficiency of convey, while a too large pitch of the magnetic poles reduces the number or frequency of generation of the magnetic brush bits. Therefore, when the circumstance does not allow the magnetic pole pitch to be set at 6.5 mm or thereabout, the magnetic pole pitch is preferably selected to fall within the range between 4 and 11 mm which provides, as shown in FIG. 13, a toner flying amount which is 0.7 times as large as the maximum fly rate $M_{max}$.

The developing device as shown in FIG. 11 employs a developer 9 is a mixture of 40 to 190 weight parts of a magnetic powder having a mean particle size of about 30 to 70 μm and consisting of ferrite powder coated with an acrylic resin or a silicon resin, and 10 weight parts of a positively chargeable non-magnetic toner having a mean particle size ranging between 7 and 15 μm. The magnet roll 3e having 16 magnetic poles and showing a magnetic field intensity of about 500 Gauss on its surface was placed in a developing sleeve having a diameter of 32 mm, so that magnetic poles were developed on the surface of the developing sleeve 2 at a pitch of about 6.5 mm. The developer 9 is applied to the surface of the sleeve to form a layer the thickness of which is regulated by the thickness regulating blade 4, and is conveyed to the area where it faces the photosensitive member 1 as a result of rotation of the sleeve and the magnet roll. This area will be referred to as "developing area" hereinafter. The developer brought to the developing area form continuous chains on the portions right above the magnetic poles, thus forming bits 8 of magnetic brush. In this example, the height of bits 8 of the magnetic brush was about 1.4 mm so that the distance between the photosensitive member 1 and the developing sleeve 2 was set at 1.6 mm so as to form a minute gap of 200 μm between the ends of the magnetic brush bits 8 and the surface of the photosensitive member 1. Although the photosensitive member 1 and the developing sleeve 2 were made to move in the directions of arrows in FIG. 11, the arrangement may be such that the developing sleeve 2 rotate in the direction counter to the direction of arrow, i.e., in the counter-clockwise direction.

A charger was operated to provide a potential of about 660 V on the surface of the photosensitive member 1 in the developing area, while a D.C. voltage of 650 V was applied to the developing sleeve 2 by means of the bias power supply 5. Under these circumstances, an electrostatic latent image formed on the photosensitive member 1, having a bright portion of 50 V and a dark portion of 660 V, was inverse-developed by non-contact development and the developed image was transferred to a copy paper. The transferred image was then fixed by a heat roll. In consequence, the toner did not attach to the portion corresponding to the bright portion of the image while a density of 1.4 or higher in terms of reflective density was obtained in the portion corresponding to the dark portion of the image. Thus, a clear print image was obtained without suffering any fogging.

A series of tests was conducted under the same condition as above, by using, as the magnet role 3e placed in the developing sleeve 2, magnet rolls having a variety of number of magnetic poles such as 8, 10, 20 and 30, so as to form magnetic pole pitches of about 13 mm, 10 mm, 5 mm and 3 mm, while forming a gap of about 200 μm between the ends of the bits 8 of the magnetic brush and the photosensitive member 1. In consequence, rates of fly of toner were obtained as shown in FIG. 13, thus providing printing density of about 0.5, 1.2, 1.3 and 0.5. A slight unevenness of the density was observed when the magnet rolls having 30 poles was used.

It will be understood from the test results that, in the non-contact type development in which a layer of a developer consisting of toner and carrier is formed on a developing sleeve and only the toner is made to fly onto the photosensitive member, it is effective to select the pitch of the magnetic poles of the magnet roll placed in the developing sleeve to fall within the range of about 4 to 11 mm (preferably about 6.5 mm) as shown in FIG. 13. Thus, a good non-contact development is realized by specifying the range of the magnet pole pitch.

Figure 14:
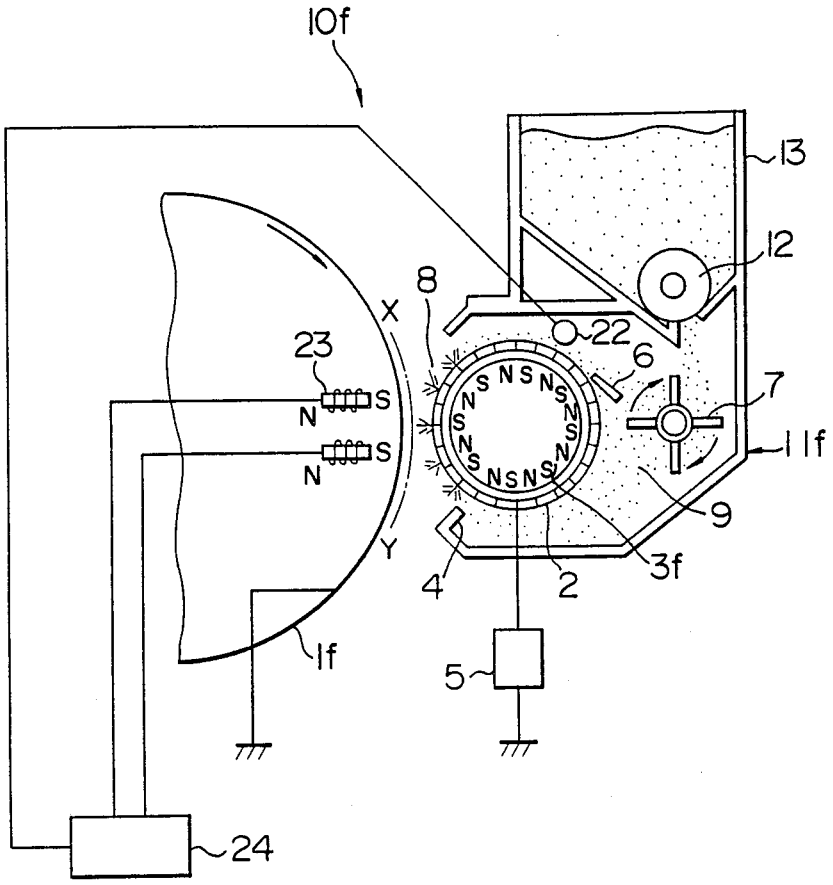
FIG. 14 is a vertical sectional view of a seventh embodiment of the present invention.

FIG. 14 shows a seventh embodiment of the present invention which differs from the sixth embodiment shown in FIG. 11 only in that a magnetic field sensor 22 capable of sensing a magnetic pole is disposed so as to face the outer peripheral surface of the developing sleeve 2, and in that solenoids 23 are disposed in the photosensitive member 1f, the on-off state of the solenoids 23, as well as the polarity of the same, being switchable in accordance with a signal from a control signal source which operates in response to a signal from the magnetic field sensor 22.

For instance, referring to FIG. 14, the magnetic poles of the solenoid 23 facing the developing sleeve 2 are controlled to have the polarity S so as to cooperate on N poles on the magnet roll 3f. With this arrangement, it is possible to raise the magnetic brush bits 8 in the circumferential region corresponding to several magnetic poles around the point of the minimum gap, in such a manner that the ends of the magnetic brush bits 8 are located on a circle (line X-Y in FIG. 13) which is concentric with the photosensitive member 1f, thus enlarging the size of the region which contributes to the flying of the toner. The seventh embodiment shown in FIG. 14, therefore, can provide a higher density of recording, though the construction is somewhat complicated as compared with the embodiment shown in FIG. 11. Thus, the seventh embodiment is effective in the case where the circumferential speed of the photosensitive member is higher than that in the embodiment shown in FIG. 11.

The sixth and seventh embodiments described hereinbefore offer an advantage in that the gap provided by the thickness regulating blade need not be reduced extremely so that problems such as clogging with the developer or formation of brooming lines on the developer sleeve can be avoided. In addition, these embodiments are effectively operable with developer carriers other than binder carrier. It is also to be noted that the size of the device can be reduced and a high-speed of non-contact development can be attained.

Figure 15:
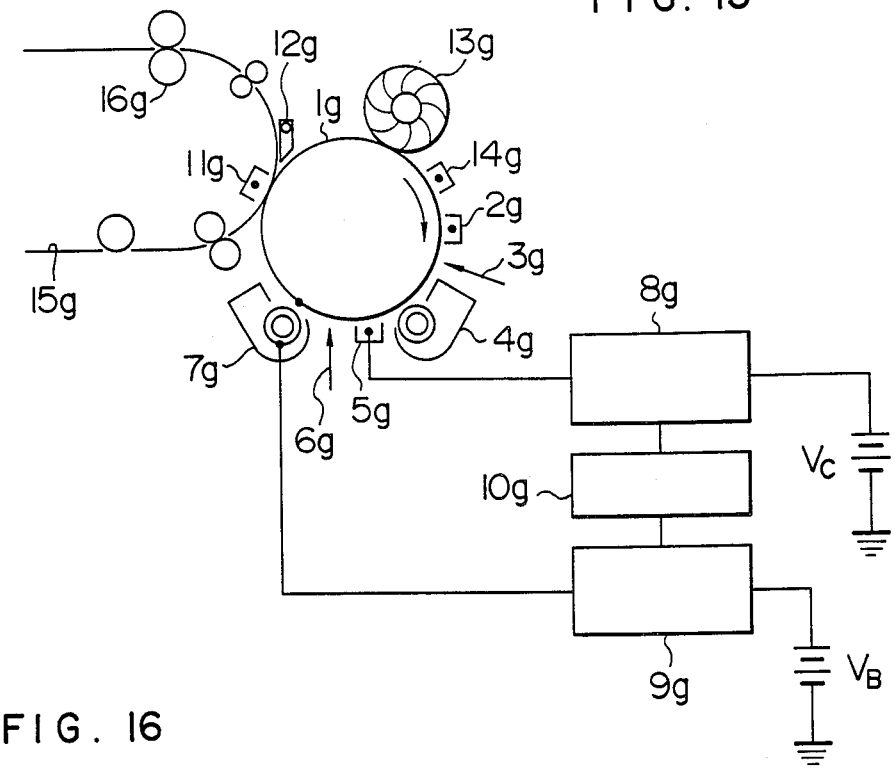
FIG. 15 is a vertical sectional view of an eighth embodiment of the present invention.

FIG. 15 shows a developing device in accordance with an eighth embodiment of the present invention. This embodiment has the systems for forming toner images of first and second colors, arranged around the photosensitive member 1. More specifically, the system for forming the toner image of the first color includes a first charger 2g, a first exposure system 3g and a first developing unit 4g, while the system for forming the toner image of the second color includes a second charger 5g, a second exposure system 6g and a second developing unit 7g. The second developing unit 7g is of non-contact development type so that it may not scrape off the toner image of the first color. Thus, a two-color toner image is formed on the portion of the photosensitive member 1g which has passed the region of the second developing unit 7g. The two-color toner image is then transferred by a transfer unit 11g to a cut paper sheet which is fed from a paper feeder cassette 15g and the transferred toner is fused by application of heat applied by a fixing unit 16g, whereby a permanent image is formed on the cut paper sheet. A reference numeral 12g denotes a separation claw for separating the cut paper sheet from the photosensitive member 1g after the transfer, while a numeral 13g designates a cleaner for removing any residual toner from the surface of the photosensitive member 1g. A charge eliminator 14g is provided for the purpose of setting the surface potential of the photosensitive member 1 at a predetermined initial level. A second charger relay 8g and a second developer relay 9g are connected, respectively, to the power supply $V_{c2}$ of the second charger 5g and the bias power supply $V_{B2}$ for the second developing unit 7g. These relays 8g and 9g are adapted to be turned on and off sequentially under the control of a sequencer 10g.

Figure 17:
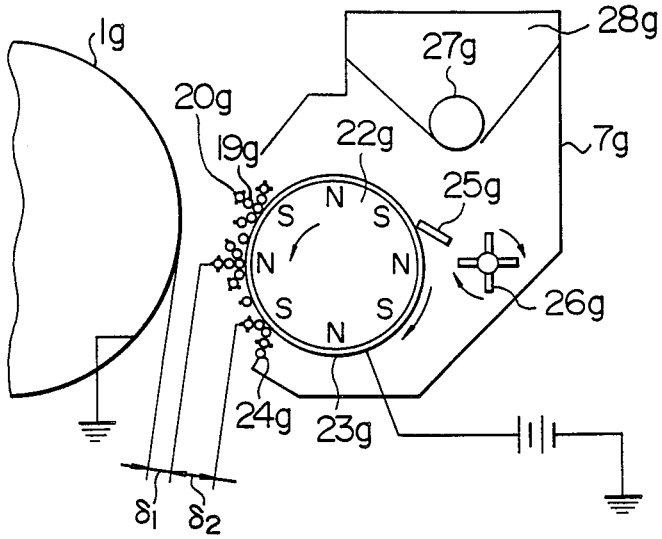
FIG. 17 is a sectional view of an essential portion of the eighth embodiment of the present invention.

FIG. 17 shows the detail of the second developing unit 7g. This developing unit 7g makes use of a bi-component developer which is a mixture of a carrier 19g and a toner 20g. A developer carrying member is constituted by a developing sleeve 23g which is rotatably disposed around a magnet roll 22g. A gap of a size $\delta_1$ is formed between the surface of the developer layer having the maximum thickness $\delta_2$ in the region where the developing sleeve 23g faces the photosensitive member 1g, so as to maintain a "non-contact" state. Then, a voltage is applied across the gap. The polarity of this voltage is the same as that in which the toner 20g is charged and the level of this voltage is equal to or slightly below the potential $V_o$ of the charged photosensitive member 1. In consequence, only the toner 20g out of the developer is made to fly, thereby to develop the image on the photosensitive member. A numeral 27g denotes a toner supply roller, 28g denotes a toner hopper, 25g denotes a scraper and 26g denotes a stirring means.

Figure 18:
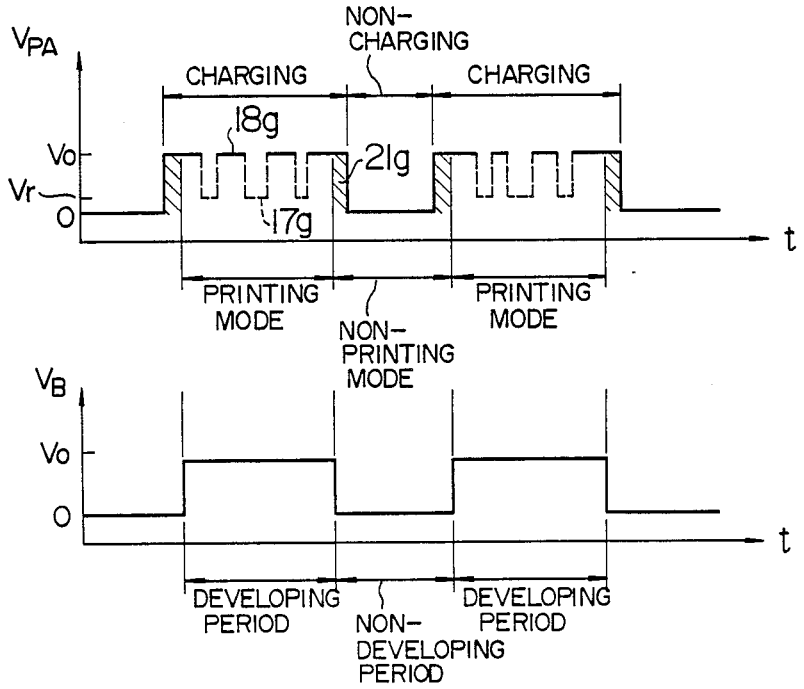
FIG. 18 is a chart illustrating changes in the surface potential of a photosensitive member and bias voltage applied to a developer carrier, in a conventional developing unit.

In the conventional recording apparatus, it is often experienced that the carrier undesirably fly towards the photosensitive member when an electric field of the reverse polarity is applied, as will be understood from the following description taken in conjunction with FIG. 18.

Referring to FIG. 18, $V_{pA}$ represents the potential of the surface of the photosensitive member in the region where the photosensitive member faces the non-contact developing device, $V_o$ represents the potential to which the photosensitive member is charged, $V_r$ represents the residual potential after the exposure, t represents the time elapsed, and $V_B$ represents the bias voltage which is applied to the developer carrying member. In the non-contact type developing device in which a D.C. voltage is used, the bias voltage $V_B$ is set at a level which is equal to or slightly lower than the potential $V_o$ to which the photosensitive member is charged. The area of the region on the photosensitive member to be charged is slightly greater than the area of the printing region on the cut paper sheet, in order to cover the entire area of the printing region. Thus, the length of time in which charging is effected by the charger is somewhat longer than the printing mode time which is required for the portion of the cut paper sheet corresponding to the printing region to pass through the developing region. In FIG. 18, the hatched area 21g represents the portion of the charging time which exceeds the printing mode time.

Exposure systems are turned on and off in accordance with the printing signal so as to form latent images within the respective printing mode time. A reference numeral 18g denotes the surface potential on the non-exposed portion, while 17g represents the surface potential of the exposed portion. In recording the image, the thus formed latent images are developed by non-contact type developing method under the application of a bias voltage. When the printing mode time is over, the bias voltage is turned off at the beginning of the subsequent non-printing mode time. In the period immediately after the turning off of the bias voltage, corresponding to the period 21g, an electric field is generated between the charged photosensitive member and the developer carrying member in the polarity which is reverse to that applied in the printing mode time. The generation of the electric field of the reverse polarity takes place also in the region 21 which is immediately before each printing mode time, i.e., immediately before the bias voltage is turned on. In consequence, the carrier component of the developer tends to fly towards the photosensitive member, as a result of application of the electric field of the reverse polarity. Unfortunately, conventional apparatus of the type described has no means for preventing such flying of the carrier. It is also to be noted that the continuation of application of the bias voltage after the termination of the printing mode time, i.e., application of the bias voltage in the non-printing mode time, causes the toner to attach to unnecessary portions of the photosensitive member, with the result that the consumption of the toner is increased and the cleaning of the photosensitive member becomes difficult. It is therefore not allowed to unlimitedly prolong the time length of application of the bias voltage.

Figure 16:
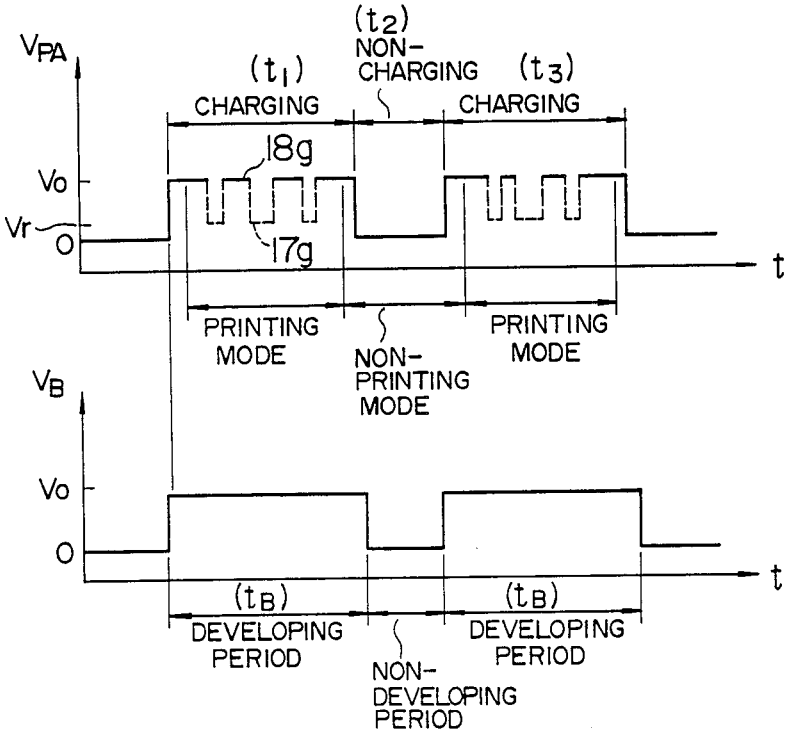
FIG. 16 is a chart illustrating changes in the surface potential of a photosensitive member and bias voltage applied to a developer carrier, in a developing unit embodying the present invention.

To obviate these problems, the present invention adopts the following control of the duration of the bias voltage. Referring to FIG. 16, $t_1$ represents the first time region in which the charged region of the photosensitive member 1g passes a point A which opposes to the non-contact developing unit 7g, while $t_2$ represents the first time region in which the non-charged region of the photosensitive member 1g passes a point A which opposes to the non-contact developing unit 7g (FIG. 15). According to the invention, the sequencer 10g controls the length $t_B$ of time of application of the bias voltage such as to meet the condition of the following formula (a).

$$\left.\begin{array}{l} t_1 \leqq t_B \leqq t_1 + \Delta t \\ 0 \leqq \Delta t < t_2 \end{array}\right\} \quad (2)$$

When the value $\Delta t$ exceeds $t_2/2$, the amount of deposition of toner to the non-printing region of the photosensitive member is increased, resulting in an increase in the toner consumption, as well as difficulty in the operation for cleaning the photosensitive member 1.

According to this arrangement, the surface potential $V_{pA}$ of the photosensitive member 1g is necessarily low in the non-printing mode time, i.e., when the bias voltage is turned off, so that the application of electric field of the polarity reverse to that in the printing mode time is avoided. It is therefore possible to prevent flying of the carrier component 19g towards the photosensitive member 1g in the non-printing mode time, when a bi-component toner composed of a toner and a carrier is used. In addition, the amount of deposition of toner to the non-printing region of the photosensitive member can be reduced by minimizing the term $\Delta t$.

As has been described, the eighth embodiment of the present invention, which is suitably applied to color electrophotographic apparatus, offers various advantages such as reduction in the toner consumption, easy cleaning of the photosensitive member, and prevention of fly of the carrier component of the developer, even when the developer is a bi-component developer which is composed of a toner component and a carrier component.

What is claimed is:

1. A non-contact type developing device for use in an electrophotographic recording apparatus which has a rotatable cylindrical sleeve, a plurality of magnets disposed in the cylindrical sleeve so as to form a plurality of magnetic poles on the surface of said sleeve, and a photosensitive member on which an electrostatic latent image is formed, and means for applying as a bias voltage on said sleeve a DC voltage no greater than a potential existent on a surface of said photosensitive member, said magnets producing magnetic attracting force which attracts a developer so as to form a magnetic brush of said developer on said sleeve, said brush of developer being conveyed by said sleeve in accordance with the rotation of said sleeve and only the toner component of said developer is made to fly to said photosensitive member as a result of application of said bias voltage without contact of said magnetic brush and said photosensitive member, said developing device characterized in that the pitch of said magnetic poles on said surface of said sleeve is varied in the region of said sleeve opposing to said photosensitive member such that the pitch of said magnetic pole is increased in accordance with increase in the circumferential distance from the point where the distance between said photosensitive member and said sleeve is minimized, whereby the heights of bits of said magnetic brush of said developer are increased in said region of said sleeve opposing to said photosensitive member.

2. A developing device according to claim 1, wherein a magnet is disposed in said photosensitive member.

3. A developing device for use in an electrophotographic recording apparatus having a developing sleeve on which a developer is applied, a photosensitive member having a surface carrying an electrostatic latent image, and means for applying a bias voltage to said developing sleeve so as to cause toner component of said developer to fly towards the surface of said photosensitive member so as to develop said latent image into a visible image, said developing device comprising: sensor means for sensing a change in the size of the gap between said photosensitive member and said developing sleeve, and means responsive to said sensor means for controlling the bias voltage in accordance with said change in the size of said gap.

4. A developing device according to claim 3, wherein said sensor means is sensitive to the position of the surface of said photosensitive member.

5. A developing device according to claim 3, wherein said sensor means is sensitive to the positions of the surfaces of said photosensitive member and said developing sleeve.

6. A developing device according to claim 3, further comprising cleaning means disposed in the vicinity of said displacement sensor and capable of cleaning the surface to be sensed by said sensing means.

7. A non-contact type developing method for use in an electrophotographic recording apparatus which has a rotatable cylindrical sleeve, a plurality of magnets disposed in the cylindrical sleeve so as to form a plurality of magnetic poles on the surface of said sleeve, and a photosensitive member on which an electrostatic latent image is formed, and means for applying as a bias voltage on said sleeve a DC voltage no greater than a potential existent on a surface of said photosensitive member, said magnets producing magnetic attracting force which attracts a developer containing a toner and a magnet carrier so as to form a magnetic brush of said developer on said sleeve, said brush of developer being conveyed by said sleeve in accordance with the rotation of said sleeve to a region where said sleeve opposed to said photosensitive member and kept such that said brush does not contact said photosensitive member, and only the toner component of said developer is made to fly to said photosensitive member as a result of application of said bias voltage, said developing method characterized in that the pitch of said magnetic pole on the surface of said sleeve in the region where said sleeve opposes to said photosensitive member is selected to fall within the range between 4 and 11 mm.

8. A non-contact type developing method according to claim 7, wherein said magnetic carrier includes magnetic particles of a means particle size ranging between 10 and 50 $\mu$m and a volume resistivity of $5\times10^3$ to $10^{14}$ $\Omega$cm.

9. A non-contact type developing method according to one of claims 7 and 8, wherein a solenoid is disposed in said photosensitive member and is controlled by a control signal generating source.

10. An electrophotographic recording method in which an electrostatic latent image on a photosensitive member is developed by a developing device into a visible toner image, and said toner image is transferred to a cut paper sheet, said method comprising:

(i) effecting non-contact development while keeping a gap between a bi-component developer layer on a developer carrying member and said photosensitive member; and (ii) applying a bias voltage to said developer carrying member throughout a period in which said developer carrying member opposes to the charged region of said photosensitive member, thereby preventing the carrier component of said developer from flying towards said photosensitive member in the period in which the development is not conducted.

11. An electrophotographic recording apparatus in which an electrostatic latent image on a photosensitive member is developed by a developing device into a visible toner image, and said toner image is transferred to a cut paper sheet, said apparatus comprising:

(i) a developing device capable of effecting non-contact development while keeping a gap between a bi-component developer layer on a developer carrying member and said photosensitive member; and (ii) voltage control means capable of applying a bias voltage to said developer carrying member throughout a period in which said developer carrying member opposes to the charged region of said photosensitive member, thereby preventing the carrier component of said developer from flying towards said photosensitive member in the period in which the development is not conducted.

12. An electrophotographic recording apparatus according to claim 11, wherein a plurality of said developer carrier members are provided so as to face said photosensitive member, and wherein said voltage control means being capable of applying a bias voltage to each said developer carrying member throughout a period in which each said developer carrying member opposes to the charged region of said photosensitive member.

* * * * *